US005415141A

United States Patent [19]

McCann

[11] Patent Number: 5,415,141

[45] Date of Patent: May 16, 1995

[54] ROTARY ENGINE WITH RADIALLY SLIDING VANES

[76] Inventor: James L. McCann, 101-1498 Harwood Street, Vancouver, British Columbia, Canada, V6G 1X6

[21] Appl. No.: 199,761

[22] Filed: Feb. 22, 1994

[51] Int. Cl.[6] ..... F02B 53/00

[52] U.S. Cl. ..... 123/243

[58] Field of Search ..... 123/229, 243

[56] References Cited

U.S. PATENT DOCUMENTS 813,018 2/1906 Okun ..... 123/243

1,229,001 6/1917 Well ..... 123/229

FOREIGN PATENT DOCUMENTS 448226 5/1948 Canada ..... 123/229

1111682 11/1955 France ..... 123/243

584155 1/1947 United Kingdom ..... 123/243

*Primary Examiner*—Michael Koczo

*Attorney, Agent, or Firm*—Norman M. Cameron

[57] ABSTRACT

A rotary device has a stator having a space therein with an oval peripheral wall. A rotor is rotatably mounted within the space. The rotor has a circular outer wall. There are two chambers on opposite sides of the stator between the peripheral wall and the outer wall of the rotor. Vanes are reciprocatingly mounted on the rotor for radial movement towards and away from the rotor. Each vane has an outer wall. There is a cam mechanism for maintaining the outer walls of the vanes in contact with the peripheral wall of the stator as the rotor rotates.

2 Claims, 4 Drawing Sheets

ROTARY ENGINE WITH RADIALLY SLIDING VANES

BACKGROUND OF THE INVENTION

This invention relates to rotary engines and, in particular, to rotary engines having interior spaces with elliptical peripheral walls and rotors within the spaces having radially slidable vanes in contact with the peripheral walls.

DESCRIPTION OF RELATED ART

Many types of rotary engines have been developed in the past, the most famous being the Wankel engine. This engine is appealing in its simplicity, having essentially only two moving parts, a triangular rotor and a splined shaft which mates with an internally splined aperture in the rotor. However, while initial scaling problems have been largely overcome, the engine has not proven to be a complete success because it is relatively inefficient compared with conventional piston engines. In short, the fuel consumption of vehicles equipped with Wankel engines is higher than for automobiles equipped with conventional piston engines having a similar power output.

Other types of rotary engines however have been developed in the past such as my own earlier axial vane rotary engine disclosed and claimed in U.S. Pat. No. 4,401,070. This engine has been the subject of considerable development work.

However, despite such earlier engine designs, no one has yet produced a commercial version of a rotary engine which overcomes past difficulties and is capable of completely replacing conventional piston engines.

SUMMARY OF THE INVENTION

It is an object of the invention to provide an improved rotary device which is simple and rugged in construction.

It is also an object of the invention to provide an improved rotary device without inherent sealing problems as encountered with some earlier designs.

It is also an object of the invention to provide an improved rotary device which has an efficiency exceeding the efficiency of conventional piston engines.

In accordance with these objects, the invention provides a rotary device having a stator with a space therein with a non-circular peripheral wall. A rotor is rotatably mounted within the space. There is a chamber between the peripheral wall of the space of the stator and the rotor. Vanes are reciprocatingly mounted on the rotor for radial movement towards and away from the rotor. Each vane has an outer wall. There is means for maintaining the outer walls of the vanes in contact with the peripheral wall of the stator as the rotor rotates.

Another aspect of the invention provides a rotary engine having a hollow stator. The stator has an interior with an elliptical peripheral wall having a minor axis and a major axis. There are bearings at the center of the interior. The stator has a pair of intake ports, a pair of exhaust ports and a spark plug which communicate with the interior. The intake ports and the exhaust ports are adjacent one end of the minor axis on opposite sides thereof. The spark plug is adjacent an end of the minor axis opposite the one end and is one side thereof. The interior of the stator has opposite side walls, each having an elliptical groove therein. A rotor has a shaft rotatably supported by the bearings in the stator. The rotor has a circular outer wall contacting the stator at the one end of the minor axis. A pair of crescent-shape spaces extend between the rotor and the stator on opposite sides of the minor axis. There is a space between the rotor and the stator at an end of the minor axis opposite the one end, and radially-extending slots spaced-apart about the rotor which communicate with the outer wall thereof. There is a radially extending vane slidably received in each of the slots of the rotor. The vanes have outer ends contacting the peripheral wall of the stator. Each vane has pins on opposite sides thereof slidably received in the elliptical grooves of the stator to maintain the outer ends of the vanes in contact with the peripheral wall. The rotor has a direction of rotation and the ports and the spark plug are positioned so each vane rotates sequentially past the exhaust port, the one end of the minor axis, the intake port, a first end of the major axis, the opposite end of the minor axis, the spark plug and a second end of the major axis.

Rotary engines and other rotary devices according to the invention offer significant advantages when compared with many earlier types of rotary engines. Proper sealing of the devices can be accomplished with relative ease. There are also fewer moving parts than with some earlier designs. Complicated porting and transfer of gases is eliminated. Also the engine is inherently balanced and does not require transverse reciprocation of vanes as with some earlier rotary engines.

DESCRIPTION OF THE PREFERRED EMBODIMENTS

Figure 1:
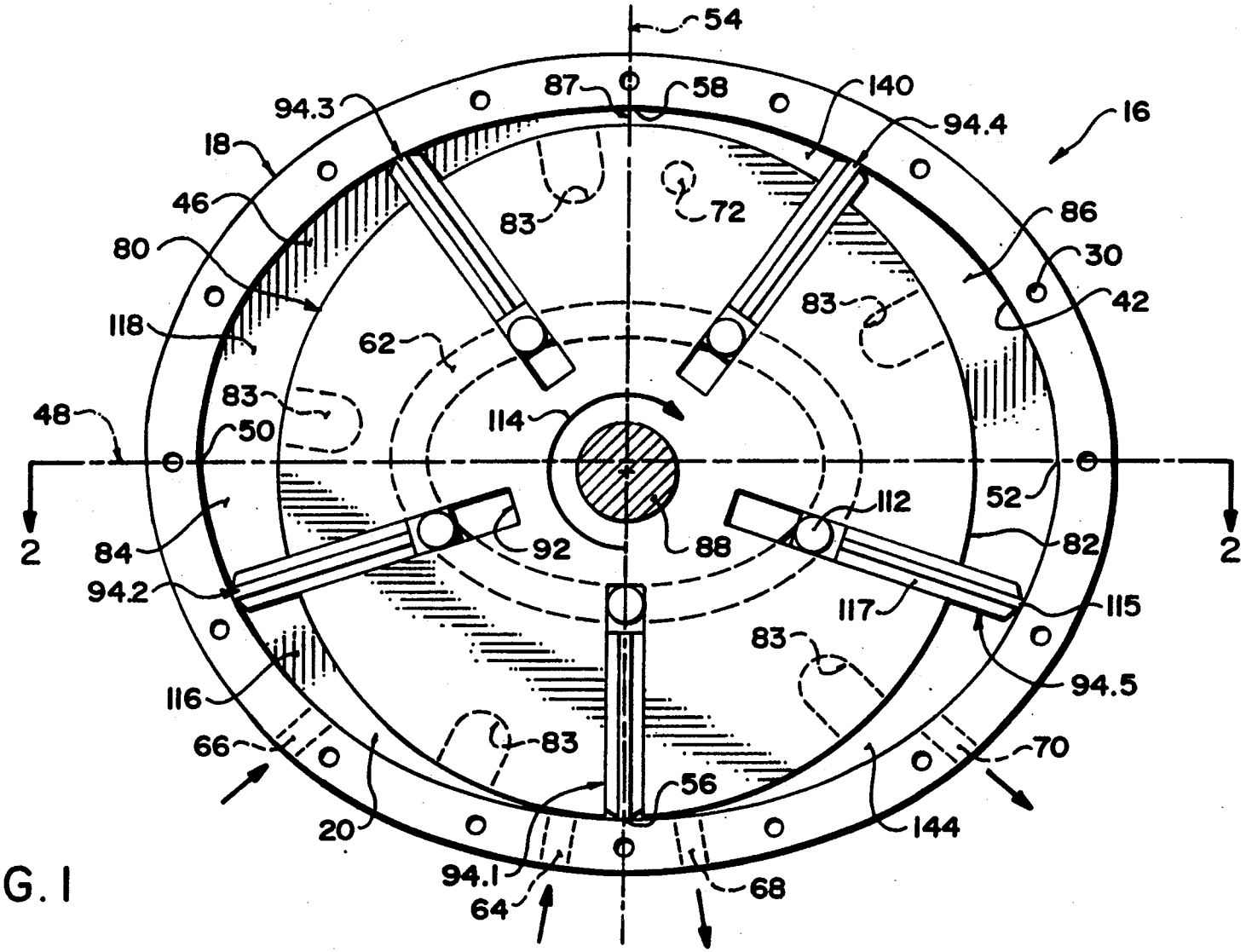
FIG. 1 is a simplified, diagrammatic side view of the interior of the stator, the intake and exhaust ports, the spark plug, the rotor and vanes of a rotary engine according to an embodiment of the invention.
Figure 2:
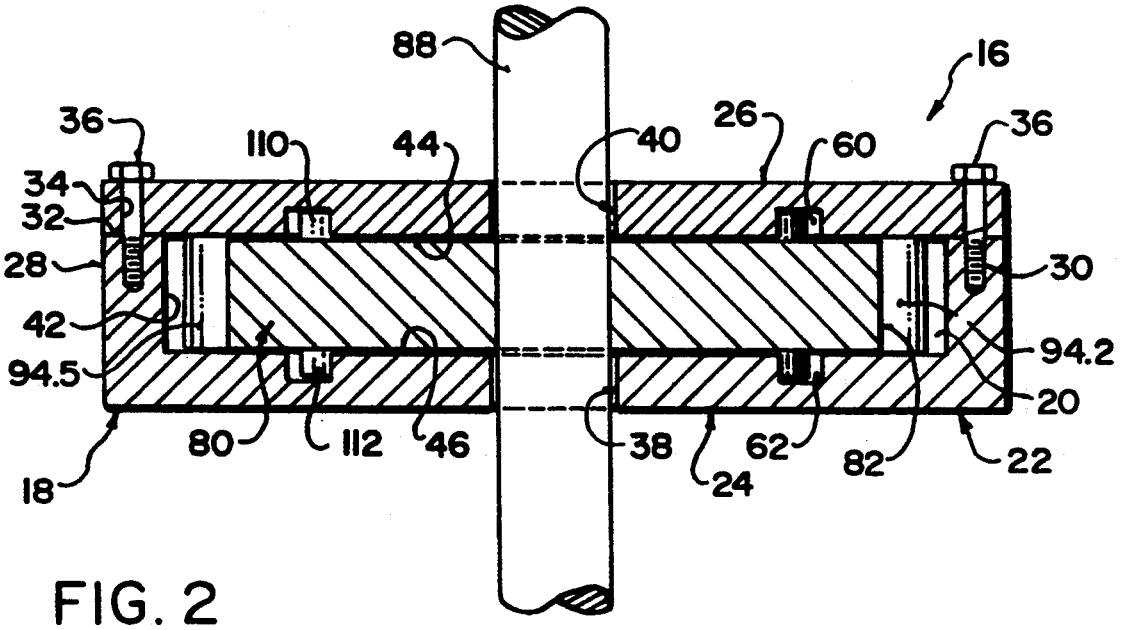
FIG. 2 is a section of the engine taken along line 2—2 of FIG. 1.

Referring first to FIGS. 1 and 2, these show a rotary device which in this instance is a rotary engine 16. The engine 16 has a stator 18, best shown in FIG. 2, which has a hollow interior 20. In this embodiment the stator has two principal components including a dish-shaped member 22 and an elliptical member 26 shown in FIG. 5. The member 22 includes an elliptical plate 24 generally corresponding in shape to the member 26. The member 22 also has a flange 28 extending completely about the plate 24. The flange has a plurality of spaced-apart threaded apertures 30 on elliptical outer end 32 thereof.

Figure 5:
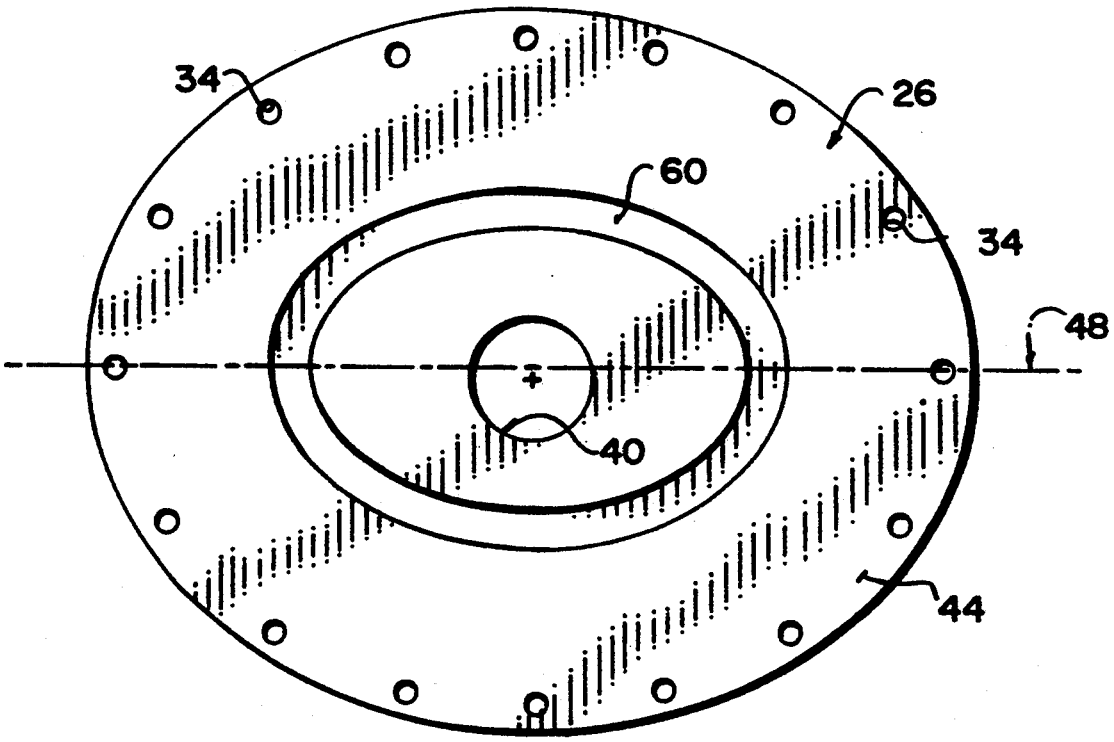
FIG. 5 is an interior side view of one side of the stator.

The member 26, shown best in FIG. 5, fits like a cover over the outer end 32 of flange 28 as shown in FIG. 2. The member 26 has a plurality of apertures 34 spaced-apart thereabout which correspond in position to the threaded apertures 30 of member 22. A plurality of bolts 36 extend through the apertures 34 in plate 26 and are threadedly received in apertures 30. Although not shown in the drawings, a suitable gasket is received between the member 26 and member 22 for sealing purposes.

The member 22 has a central aperture 38 while member 26 has a corresponding aperture 40. Although not shown in the drawings, these apertures are fitted with suitable; bushings or bearings, such as roller bearings.

It will be seen therefore that the interior 20 of the stator is elliptical in section as best seen in FIG. 1. Possibly the shape could be other oval shapes rather than a pure ellipse. The interior has a peripheral wall 42 which is elliptical when seen from the side and flat from side-to-side as seen in FIG. 2. The interior also has elliptical side walls 44 and 46 which are formed by inside faces of the member 26 and the elliptical plate 24 respectively.

As seen in FIG. 1, the elliptical interior of the stator has a major axis 48 having a first end 50 and a second end 52 adjacent the peripheral wall of the stator. The interior also has a minor axis 54 having a first end 56 adjacent the peripheral wall 42 and a second end 58 adjacent the peripheral wall. By definition the major axis is the longer axis of the ellipse and is perpendicular to the minor axis.

Side wall 44, shown in FIG. 5 has an elliptical groove 60 extending about aperture 40 which is located centrally with respect thereto. The groove is similar in shape, but smaller, than the elliptical peripheral wall 42 shown in FIGS. 1 and 2, and has major and minor axes aligned with the major and minor axes 48 and 54 shown in FIG. 1. The groove 60 may be seen also in FIG. 2 which also shows a corresponding elliptical groove 62 in side wall 46.

The stator also has intake ports 64 and 66 which extend through the stator to communicate with hollow interior 20 adjacent the peripheral wall 42. In this particular instance two circumferentially spaced-apart intake ports are used although in alternative embodiments either a single intake port or more than two intake ports could be employed. The intake ports are adjacent first end 56 of the 5minor axis 54 which corresponds to the narrowest dimension of the stator. Likewise there are two exhaust ports 68 and 70 adjacent the first end 56 of the minor axis, but on the opposite side thereof compared to the intake ports 64 and 66. Again the number of exhaust ports could vary from what is illustrated in this embodiment.

Figure 11:
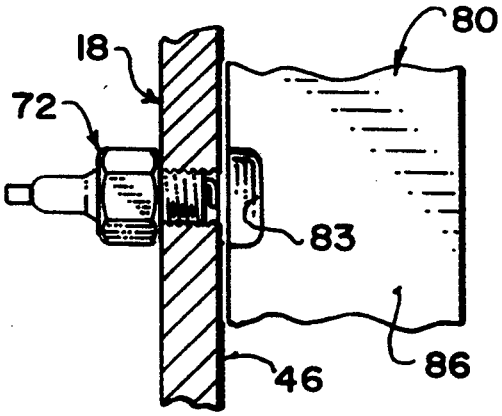
FIG. 11 is a fragmentary end view of the rotor and of the stator in section showing a pre-combustion chamber on the rotor and a spark plug.

There is also a spark plug 72 which extends into the stator to communicate with the hollow interior adjacent second end 58 of the minor axis to one side thereof. In this embodiment the spark plug is in side wall 46 of stator 18 as seen best in FIG. 11. The spark plug could be deleted for a diesel version of the engine however. The version of the engine illustrated in the drawings does not include a fuel injector in the stator, therefore the mixture of air and fuel is taken into the hollow interior through the intake ports 64 and 66. Alternatively a fuel injector could be directly fitted to the stator to inject fuel at a position dependent upon the configuration and type of engine. It should also be understood that the invention is applicable to other types of rotary devices such as compressors or pumps and modifications to the ports can be made by someone skilled in the art to accomplish such alternative applications. A spark plug or other ignition means is deleted for pump and compressor applications.

Figure 3:
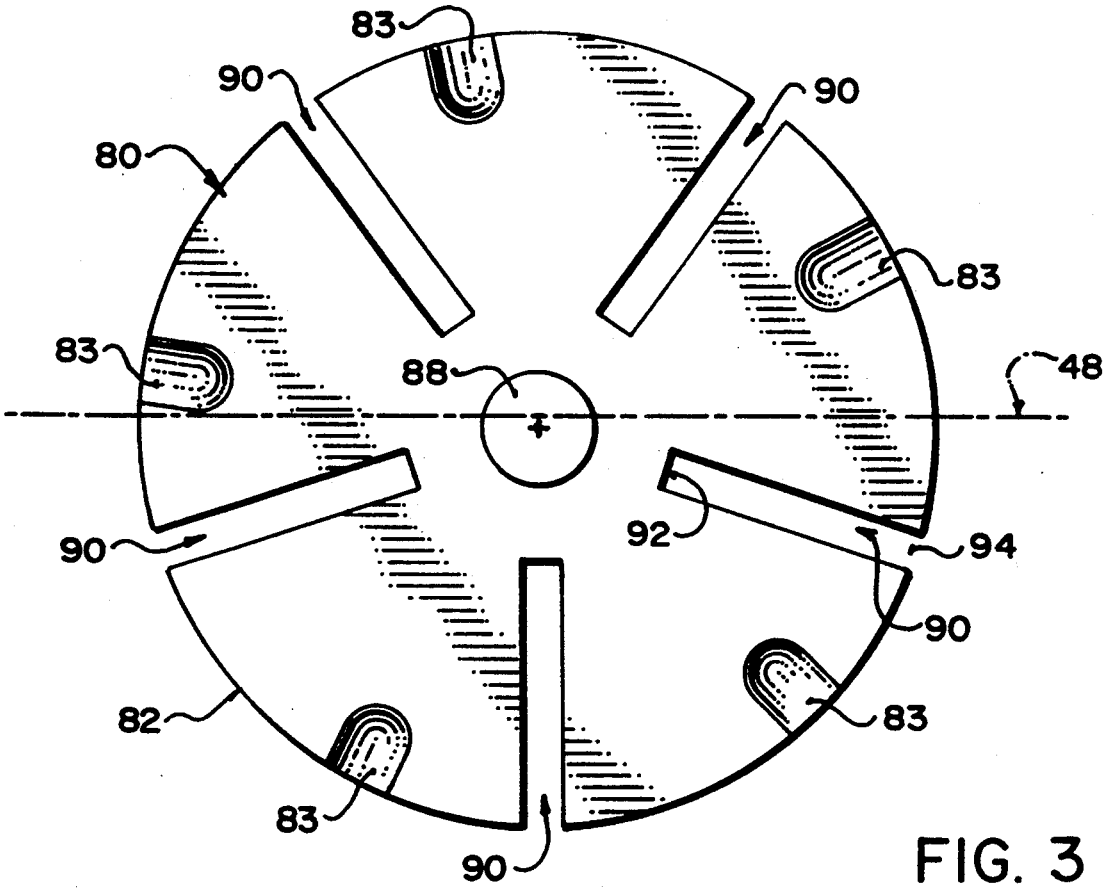
FIG. 3 is a side view of the rotor thereof.

A rotor 80 is fitted within the hollow interior of the stator as shown in FIGS. 1, 2 and 3. The rotor has an outer wall 82 which is circular when seen from the side as in FIGS. 1 and 3 and flat from side-to-side in this example as seen in FIG. 2. The outer wall has the diameter slightly smaller in extent than the length of the minor axis of the hollow interior of the stator between its ends 56 and 58. The rotor sealingly engages the peripheral wall 42 adjacent the first end 56 of the minor axis. However, the rotor is spaced-apart from the peripheral wall 42 on both sides of the minor axis as best seen in FIG. 1, forming two crescent-shaped spaces 84 and 86 between the rotor and stator. These spaces have their greatest depth along the major axis 48 as seen in FIG. 1. The rotor is also spaced apart from wall 42 adjacent to end 58 of minor axis 54 by a gap 87. The size of the gap 87 in FIG. 1 is exaggerated for illustrative purposes.

Figure 4:
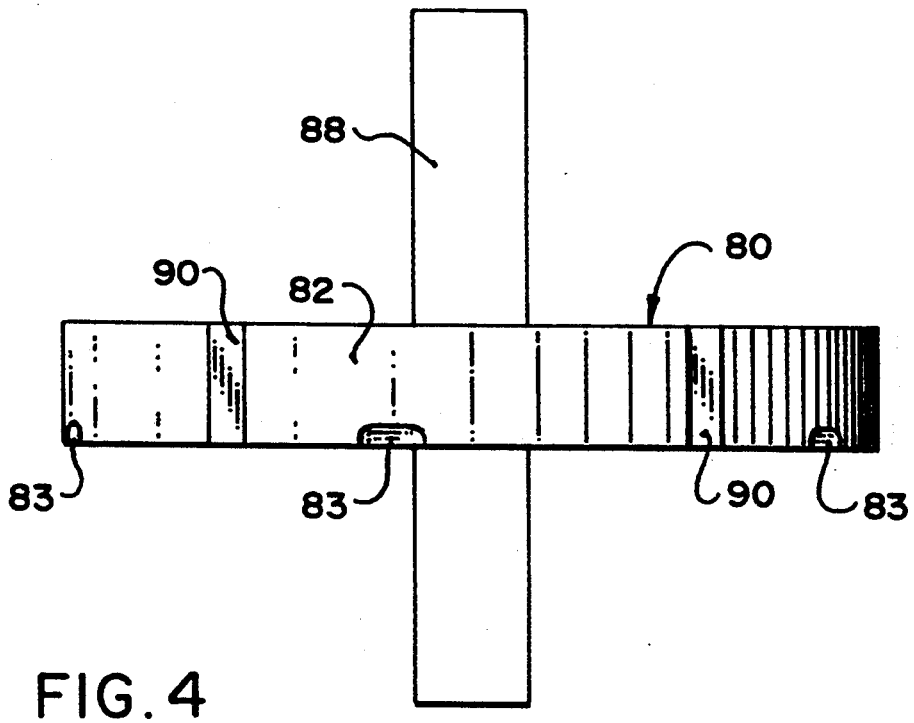
FIG. 4 is a top plan of the rotor and shaft thereof.

The rotor has a shaft 88 thereon as seen in FIGS. 2, 3 and 4. The shaft is located centrally on the rotor and is just slightly smaller in size than the apertures 38 and 40 in the stator so as to rotatably support the rotor within the hollow interior 20 of the stator. The shaft 88 serves as a power shaft for the engine or a drive shaft for a compressor or pump if the device is so re-configured. The gap 87 is achieved by offsetting the shaft slightly from the center of the stator towards the first end 56 of the minor axis.

The rotor also has five radially extending slots 90, best seen in FIG. 3, which extend radially outwards to outer wall 82 thereof. The slots 90 are spaced-apart 72° from each other in this embodiment. The number of slots could vary in other embodiments of the engine however. Each slot has an inner end 92 at a radially inner position spaced-apart from shaft 88 and an outer end 94 adjacent the outer wall of the rotor. The slots extend completely through the rotor from side-to-side and completely through the outer wall 82 in this embodiment.

The rotor also has five pro-combustion chambers 83. Each chamber 83 is between one pair of slots 90 as shown in FIG. 3. The chambers 83 extend inwardly from outer wall 82 of the rotor on the side thereof facing side wall 46 and spark plug 72. Each chamber is aligned with the spark plug at one rotational position of the rotor.

The engine 16 has a plurality of vanes 94, shown in detail in FIGS. 6–10, which correspond in number to the slots 90. Accordingly there are five such vanes 94 in this engine as shown in FIG. 1 and numbered 94.1, 94.2, 94.3, 94.4 and 94.5. Again, the number of vanes could vary as could the number of slots on different embodiments however. Each vane has a body 96, shown in FIGS. 7 and 8, in the shape of a rectangular parallelepiped, having opposite rectangular faces 98 and 100, narrower rectangular sides 102 and 104, an inner end 106 and a rectangular outer end 108. The inner end is connected to an inner portion 109, also a rectangular parallelepiped, with a shoulder 111 therebetween. Each vane also has a pair of pins 110 and 112, which are cylindrical shape in this embodiment, and which extend outwardly on opposite sides of the inner portion 109.

Figure 6:
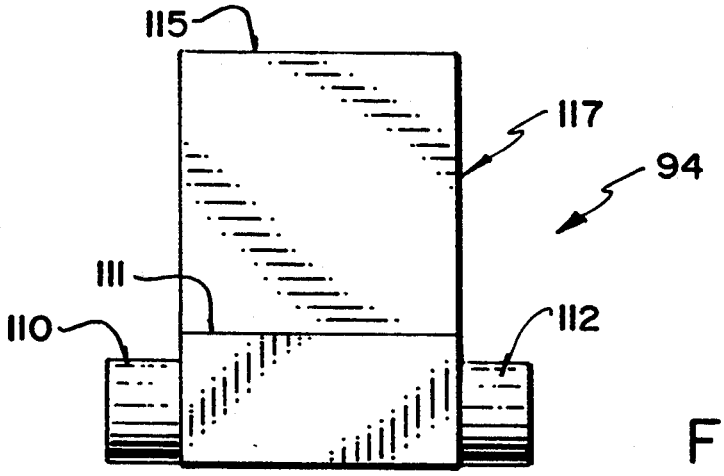
FIG. 6 is a front view of one of the vanes with seals fitted thereon.
Figure 7:
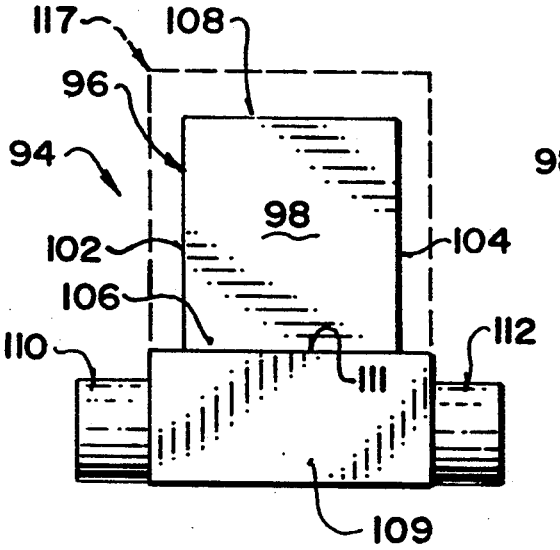
FIG. 7 is a front view of the vane of FIG. 6 without the seals.
Figure 8:
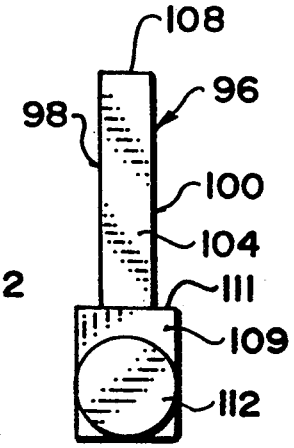
FIG. 8 is a side view of the vane of FIG. 7 without the seals.

The pins 110 and 112 are slidably received within the elliptical grooves 60 and 62 respectively in the side walls 44 and 46 as seen in FIGS. 1 and 2. The pins are placed on the vanes and the vanes are dimensioned such that outer ends 115 of the vanes, shown in FIGS. 1 and 6, are maintained in contact against the peripheral wall 42 of the stator as the rotor rotates. The pins slidably received in the elliptical grooves 60 and 62 act as cam followers and cams respectively and cause the vanes to reciprocate radially inwardly and outwardly to conform to the shape of the peripheral wall 42 and remain in sealing contact therewith throughout the rotation of the rotor.

Figure 10:
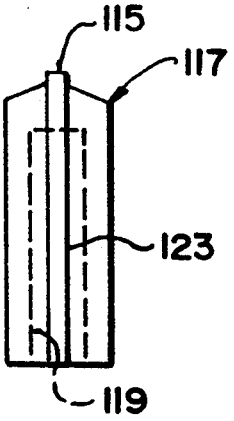
FIG. 10 is a side view of the seals.
Figure 9:
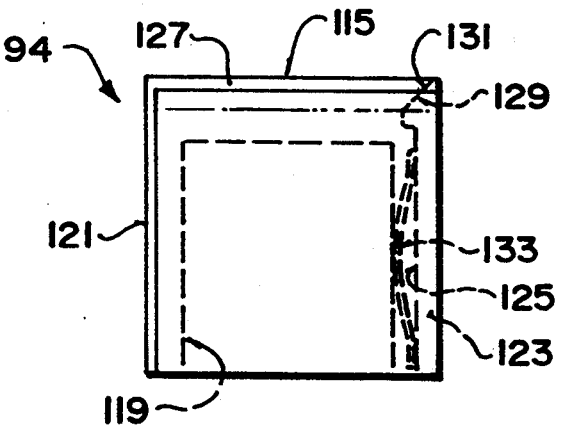
FIG. 9 is a front view of the seals for the vane of FIGS. 7 and 8.

Referring to FIGS. 9 and 10, each vane 94 has a hollow seal member 117 having an internal recess 119 shaped to slidingly fit over the body 96 as shown in FIG. 6. Each seal member has a fixed outer seal 127 extending along outer end 115 of the vane and a fixed seal 121 on one side thereof. There is a movable seal 123 slidingly received in a slot 125 extending along the opposite side. Seal 127 has a bevelled end 129 which receives bevelled end 131 of the seal 123. This allows the seal 123 to slide toward or away from both the seals 127 and 121. A leaf spring 133 in slot 125 biases seal 123 outwardly. In this embodiment the vanes and seals are of zirconium boride although other materials could be substituted.

Strictly speaking additional seals are not required for operation of the engine 16 if it is built to tight tolerances. However, seals can be fitted to reduce machining tolerances and to improve sealing during heating and cooling of the engine. These seals, though not shown in the drawings, may also include one or more annular seals extending about each side of the rotor, and annular and linear seals on the interior of the stator, particularly adjacent the ends 56 and 58 of the minor axis.

OPERATION

The operation of the engine is best understood with reference to FIG. 1. The direction of rotation of the rotor 80 of this engine is clockwise as indicated by arrow 114 although the direction could be reversed by repositioning the various ports and the spark plug. Each cycle of the engine begins with a vane in the position of the bottom vane 94.1 shown in FIG. 1. The vane moves clockwise past the intake ports 64 and 66. A chamber 116 is then formed between the vane, the side walls 44 and 46 of the stator and the first end 56 of the minor axis where the rotor sealingly engages the peripheral wall 42. The size of this chamber increases as the vane reaches the approximate position of the vane 94.3. Once this occurs, chamber 118 is then defined between the vane 94.3 and the preceding vane 94.2 referring to the direction of rotation of the rotor. The gases are sealed within this chamber once the vane 94.2 has rotated past the ports 64 and 66. The gases are compressed in chamber 140 as the vane approaches the position shown for vane 94.3. Once the pre-combustion chamber 83 between vanes 94.3 and 94.4 has rotated into alignment with the spark plug 72, the compressed gases are ignited by the spark plug and propel the rotor clockwise in the direction of rotation to provide the power stroke. Expansion occurs because the space between the vanes increases as the rotor rotates as seen by comparing chambers 140 and 142.

The exhaust stroke is accomplished by the following vane. When this vane has achieved the position of vane 94.5 to the right of FIG. 1, it begins to compress the exhaust gases in chamber 144 and thus forces the gases out through the exhaust ports 68 and 70. The cycle begins again when the vane achieves the position of vane 94.1 at the bottom of FIG. 1.

There are two exhaust ports 68 and 70 to avoid unnecessary, and counterproductive, compression of the exhaust gases. They are initially forced out through port 70 and then through port 68 after the leading vane has passed port 68 and the following vane has passed port 70. Likewise there are two intake ports 64 and 66 so that intake can begin as soon as a vane passes port 64, but can continue even after port 64 is passed by the following vane until it passes port 66.

It will be understood by someone skilled in the art that many of the details provided above are by way of example only and can be altered or deleted without departing from the scope of the invention which is to be interpreted with reference to the following claims.

What is claimed is:

1. A rotary engine comprising:

a hollow stator having an interior with an elliptical peripheral wall having a minor axis and a major axis, side walls extending radially inwardly on each side of the peripheral wall, bearings at the center of the interior and a pair of circumferentially spaced-apart intake ports, a pair of circumferentially spaced-apart exhaust ports and a spark plug which communicate with the interior, the intake ports and the exhaust ports being adjacent one end of the minor axis on opposite sides thereof, the spark plug being adjacent a second end of the minor axis which is opposite the one end and to one side of the second end, the side walls each having an elliptical groove therein;

a rotor having a shaft rotatably supported by the bearings in the stator, having a circular outer wall contacting the stator at the one said end of the minor axis, a pair of crescent-shaped spaces extending between the rotor and the stator on opposite sides of the minor axis, a space being between the rotor and the stator at the second end of the minor axis, and radially-extending slots spaced-apart about the stator and communicating with the outer wall thereof; and a radially extending vane slidably received in each of the slots of the rotor and having an outer end contacting the peripheral wall of the stator, each said vane having pins on opposite sides thereof slidably received in the elliptical grooves of side walls of the stator to maintain the outer ends of the vanes in contact with the peripheral wall of the interior of the stator, the rotor having a direction of rotation and the ports being positioned so each said vane rotates sequentially past the one end of the minor axis, the intake ports, a first end of the major axis, the opposite end of the minor axis, the spark plug, a second end of the major axis and the exhaust ports, the rotor having a recess extending radially inwardly from the outer wall thereof between each pair of said vanes and extending axially outwardly to at least one said side wall of the stator interior, the spark plug communicating with the interior of the stator on said one side wall at a position to communicate with said each recess as said each recess rotates past the spark plug.

2. A rotary engine as claimed in claim 1, wherein the rotor is offset in the stator toward the one end of the minor axis.

* * * * *